US007237781B2

(12) United States Patent
Canova

(10) Patent No.: US 7,237,781 B2
(45) Date of Patent: Jul. 3, 2007

(54) MECHANICS CHAIR WITH SIDE TRAY

(76) Inventor: James D. Canova, 131 El Bosque Dr., San Jose, CA (US) 95134

( * ) Notice: Subject to any disclaimer, the term of this patent is extended or adjusted under 35 U.S.C. 154(b) by 205 days.

(21) Appl. No.: 10/986,633

(22) Filed: Nov. 12, 2004

(65) Prior Publication Data

US 2005/0098966 A1 May 12, 2005

Related U.S. Application Data

(60) Provisional application No. 60/519,563, filed on Nov. 12, 2003.

(51) Int. Cl.
*B25H 5/00* (2006.01)

(52) U.S. Cl. ..... 280/32.6; 280/79.2; 297/188.01

(58) Field of Classification Search ..... 280/32.5, 280/32.6, 79.2; 297/188.01, 173, 188.08; D6/349; D34/23
See application file for complete search history.

(56) References Cited

U.S. PATENT DOCUMENTS 4,832,355 A * 5/1989 Hung ..... 280/32.5
4,895,380 A 1/1990 Brooks et al. ..... 280/32.6
4,957,302 A * 9/1990 Maxwell ..... 280/32.6
5,108,118 A 4/1992 Schaevitz ..... 280/32.6
5,330,211 A * 7/1994 Nicholson ..... 280/32.6
5,503,415 A * 4/1996 Powell ..... 280/32.6
5,577,744 A 11/1996 Parks ..... 280/32.6
5,624,126 A * 4/1997 Vosbikian et al. ..... 280/32.6
5,685,468 A * 11/1997 Hernandez et al. ..... 224/492
D401,715 S * 11/1998 Whiteside et al. ..... D34/23
5,853,180 A * 12/1998 Taylor ..... 280/32.6
5,897,122 A 4/1999 Borner ..... 280/32.6
6,010,187 A * 1/2000 Dallas et al. ..... 297/188.08
6,702,065 B2 * 3/2004 Ehnes ..... 182/150
6,702,305 B2 * 3/2004 Miles ..... 280/32.6
6,733,073 B2 * 5/2004 Whiteside et al. ..... 297/188.08
6,857,644 B2 * 2/2005 Hsiao ..... 280/79.2
6,969,077 B2 * 11/2005 Liu ..... 280/30
D524,006 S * 6/2006 Verb ..... D34/17
D530,108 S * 10/2006 Whiteside et al. ..... D6/349
D532,177 S * 11/2006 Hernandez ..... D34/23

OTHER PUBLICATIONS

Pamphlet printout: "Griot's Garage" Garage Handbook No. 169, 2 pages.

* cited by examiner

*Primary Examiner*—Christopher P. Ellis
*Assistant Examiner*—Brian L Swenson
(74) *Attorney, Agent, or Firm*—Schneck & Schneck; David M. Schneck

(57) ABSTRACT

A creeper chair having a frame, a seat and at least one side platform flanking said seat. The platform includes a product-retaining holder in any combination of number, sizes and shapes to secure various products and supplies or tools to said platform.

14 Claims, 1 Drawing Sheet

MECHANICS CHAIR WITH SIDE TRAY

CROSS-REFERENCE TO RELATED APPLICATION

This application claims priority from provisional application Ser. No. 60/519,563, filed Nov. 12, 2003.

TECHNICAL FIELD

This invention relates generally to mobile chairs and specifically to a mechanics creeper type chair.

BACKGROUND OF THE INVENTION

Mechanics, car repair technicians and other personnel have used a number of creeper devices and rolling seats. Primarily such devices are used below a partially raised vehicle (e.g. a vehicle raised on jacks or driven onto raised wheel supports at the front).

U.S. Pat. No. 4,895,380 discloses a creeper having an adjustable support platform mounted on a number of wheels. A portion of the elongate support surface is angularly adjustable, with the adjustable joint designed to allow adjustment even if a load is on the support surface. A headrest is included.

U.S. Pat. No. 5,108,118 discloses a creeper having a tilt adjustable elongate support surface mounted on a number of wheels. A hooking wire structure allows tilt alignment.

U.S. Pat. No. 5,577,744 is a multipurpose utility cart having a rigid platform and a pivotal support bracket that can angularly adjust a support cushion mounted on two arms. The arms are joined at one end to the support bracket. This allows the device to be used as a mechanics creeper when the cushion is lowered. When the support cushion is raised by angular adjustment of the arm position using the bracket, the device may be used as a mobile seat.

U.S. Pat. No. 5,897,122 discloses a mechanics reclining chair mounted on a rectangular wheeled platform having a molded plastic chair affixed to the platform. The back is reclined by raising the front of the chair using a pair of struts mounted onto the frame. A drawer beneath the seat may be included.

All of the above creeper devices are designed for working underneath a car, either exclusively or as one of the intended uses. For this reason the width of the wheeled device must be sufficiently narrower than the distance separating the inner surfaces of the tires such that sufficient clearance of the creeper between the vehicle tires is provided. Such devices are commonly less than shoulder width apart, and nothing extends from the sides of these creeper devices. While this allows a user to move past wheel stands, it limits the location for placement of tools or required materials.

Such features make the disclosed creepers less useful for those who are not working underneath a car, but along the sides of the car. In these applications, the creeper device does not have to be only as wide as the wheelbase. For example, during auto detailing, e.g. automotive cleaning, polishing, waxing, etc. and also during standard or custom automotive painting work (including prep work), the creeper device is moved about the exterior of the automobile as the lower areas of the automobile are worked on. Another example could be interior house painting of lower wall and trim areas or any type of application that requires working on low areas. During the process of any of these examples it would be convenient if a number of different products, e.g. cleaners, polishes, waxes and paint) and supplies or tools were easily accessible. In addition, the storing of these various products and supplies or tools in a stable location on the creeper would prevent a worker from unintentionally knocking over a product, supply or tool while working on the lower areas of an automobile or other vehicle [or in other applications such as interior house painting or other applications that require working on low areas]. This is less of a problem for creepers used under vehicles, where the creeper is moved most commonly to a single location and fewer products which can be upturned are used.

It is an object of the invention to provide a creeper that can be used during auto detailing standard or custom painting of an automobiles exterior (including prep work) and other similar work such as interior house painting of lower wall areas and trim or any application that requires working on lower areas, and allow multiple products and supplies to be securely held on the creeper.

SUMMARY OF THE INVENTION

The above objects have been achieved with a rolling device including a rectangular frame onto which a seat is mounted. The seat may be bolted to the frame and in one embodiment support at least a portion of the user's back. Flanking one or both sides of the seat is a platform also mounted on the frame. Affixed to the platform can be any combination of retaining holders of any size or shape to secure various products and supplies or tools on to the rolling device.

DETAILED DESCRIPTION OF THE INVENTION

Figure 1:
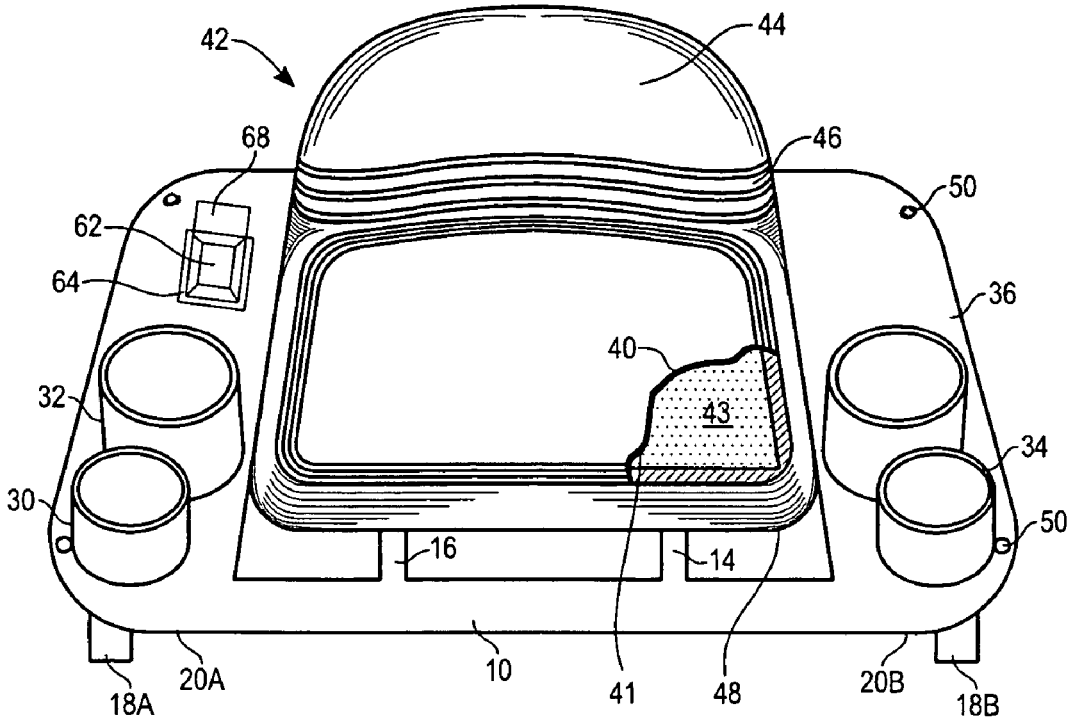
FIG. 1 is a top perspective view of the creeper of the present invention.

With reference to FIG. 1, the illustrated embodiment includes a rectangular metal frame 10. Preferably, this frame has rounded corners. In addition the frame may be padded (e.g. with a shock absorbing foam, rubber, plastic, or other shock absorbent material). Welded onto rectangular frame 10 are frame struts 14, 16 that extend from the front of the frame to the back of the frame.

Mounted on struts 14, 16 is a seat 42. Seat 42 includes a bottom portion 40, a half back support 44 and bend grooves 46. In other contemplated embodiments seat 42 may include full back support or none at all. The corner cutaway shows seat 42 is comprised of outer shell 41, which is fitted over metal seat form 48. Glued onto form 48 is foam section 43 to give the seat and back padding to make use more comfortable. Another contemplated embodiment would use an injection molded plastic seat.

Flanking either side of seat are platforms 20*a*, 20*b* secured by nuts 50 to frame 10. The platforms may be welded to frame 10. This may be in addition to or an alternative to being secured by a nut/bolt combination. On platform 20*a* product retaining holders 30, 32 are affixed to the platform. Products or other supplies may be retained within these holders. Similarly, a second platform 20*b*, flanking an opposite side of seat 42 also has attached holders 34, 36 for holding products or other supplies. A product placed into a retaining holder is unlikely to tip as the wheeled seat is rolled over a surface. Each of the retaining rings holders 30, 32 may be different sizes or shapes, for example to hold a relatively larger and a relatively smaller specific type of products or supplies.

"Holder" as used herein is a separate structure on a platform able to hold an article sufficiently securely that the article does not slide off the platform when it is moved. Retaining rings and trays are examples of holders.

Platform 20*a* is also shown as having a tray 62 held by tray lip 64 in a hole 68 on platform 20*a*. This tray insert may be used to hold polish and waxing products, cloths, or other devices not contained within cans.

At the corner of the device are wheels 18*a*, 18*b*. Wheels are positioned at the four corners of frame 10. The wheels are preferably wheels having a solid polymeric tire mounted on an axle held by a bracket. A post on the bracket extends through holes on frame 10 and platform 20*a* or 20*b*. A threaded end of the post is secured by locking nut 50. In this manner the bracket on the wheel may both secure the wheel and the platform to the frame. The wheel brackets are preferably ball bearing mounted such that the wheel may freely rotate on its axis and the wheel may turn in any direction.

Figure 2:
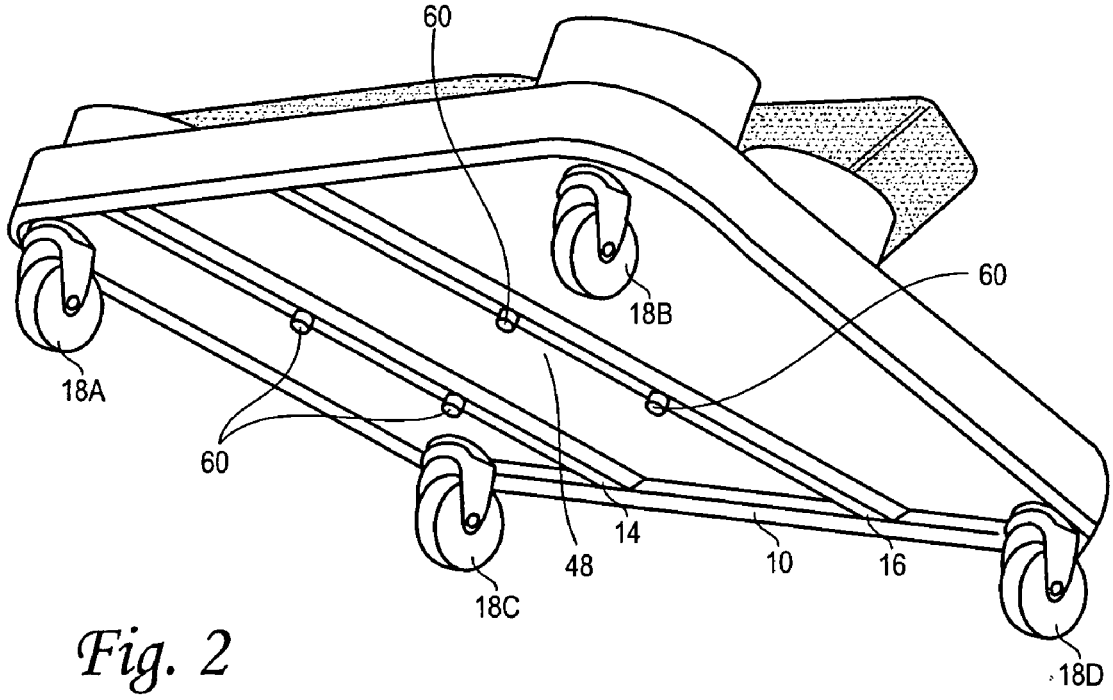
FIG. 2 is a bottom perspective view of the creeper shown in FIG. 1.

With reference to FIG. 2, the bottom of the device shows bolts 60 that extend through struts 14, 16 and into seat frame 48. Bolts are then secured by locking nuts to securely fasten the seat onto the struts 14, 16. The wheels 18*a*, 18*b*, 18*c*, and 18*d* are positioned at the corners of frame 10. The wheels include a bracket having a mounting bolt that extends through frame 10 and platform 20*a* or 20*b*. This bolt is then secured with locking nut 50. The position of this bolt at the outside edge of the frame and platform gives the platform added stability and reduces the risk of the platform spilling.

The term "creeper" as used herein refers exclusively to wheeled structures having a seat or platform at or below the level of the bottom of an auto body at the door location on a sedan style automobile with standard suspension. The level of a seat on a creeper is not more than twelve inches from the level of a surface on which the creeper rests.

The frame 10 and struts 14, 16 may be hollow core steel sections joined by welding. Platforms 20*a*, 20*b* and seat form 48 are also made of steel and joined by bolts and locking nuts, welding, or both. The device is has relatively few parts and is simple to manufacture. Gluing a foam structure over seat form 48 and affixing a shell over the foam then make the seat. Preferably the edge of the shell may be fit over the seat form 48, again allowing simple assembly. The seat could also be an injection molded plastic structure.

As shown in FIG. 1, the seat 42 does not extend to the front edge of frame 10. This is also the case for the back edge. This allows both the front and back edge to be used as handles to carry the device by hand if needed. The seat back 44 also allows the device to be stored with the back resting on a floor surface and the frame parallel to a wall. In this storage position the device will take up a minimal amount of floor space and will not roll away.

The invention claimed is:

1. A creeper device comprising:

a rectangular frame;

four wheels joined to four corner locations of a bottom side of said frame;

a seat mounted directly onto the top side of said frame such that a bottom of said seat is substantially level with a top of said wheels;

at least one platform mounted on said top side of said frame flanking said seat; and a plurality of product retaining holders mounted on said platform.

2. The device of claim 1, wherein said at least one platform includes a first platform flanking a first side of said seat and a second platform flanking a second side of said seat.

3. The device of claim 1, wherein said seat includes a base bolted to said frame, padding secured over said base, and an outer shell secured over said base.

4. The device of claim 1, wherein said platform also includes an insertable tray.

5. The device of claim 1, wherein said seat is mounted such that the bottom of the seat is not more than twelve inches from a surface on which the four wheels rest when said wheels are placed on said surface.

6. The device of claim 1, wherein said frame is comprised of hollow core steel sections.

7. A device comprising:

a rectangular metal frame;

two metal struts extending from a front of said frame to a back of said frame;

a seat having a seat bottom mounted on said struts;

at least one platform flanking said seat mounted to said frame;

at least one retaining holder attached to said at least one platform; and four wheels attached to four corners on a bottom side of said frame.

8. The device of claim 7, wherein said seat includes a half back support.

9. The device of claim 7, wherein said seat includes an outer shell mounted over a metal seat form.

10. The device of claim 7, further including a tray hole on said at least one platform.

11. The device of claim 7, wherein said four wheels each include a wheel post extending through said frame and secured by a locking nut.

12. The device of claim 7, wherein said metal frame is comprised of hollow core steel sections.

13. The device of claim 7, wherein said frame is padded.

14. The device of claim 7, wherein said seat bottom is attached to said struts such that the bottom of the seat is not more than twelve inches from a surface on which the four wheels rest when said wheels are placed on said surface.

* * * * *